US008450655B2

(12) United States Patent
Chao et al.

(10) Patent No.: US 8,450,655 B2
(45) Date of Patent: May 28, 2013

(54) DYE SUBLIMATION HEATING MODULE AND SYSTEM THEREOF

(75) Inventors: Kuang Cheng Chao, New Taipei (TW); Chien-Yi Ho, Taipei (TW); Kuang-Chien Chao, Keelung (TW)

(73) Assignee: Ocean Net, Inc., New Taipei (TW)

( * ) Notice: Subject to any disclaimer, the term of this patent is extended or adjusted under 35 U.S.C. 154(b) by 179 days.

(21) Appl. No.: 13/113,333

(22) Filed: May 23, 2011

(65) Prior Publication Data

US 2012/0301122 A1 Nov. 29, 2012

(51) Int. Cl.
*F26B 3/30* (2006.01)

(52) U.S. Cl.
USPC ..... 219/407; 392/407; 392/411; 392/417; 392/432; 392/433; 392/435; 392/436; 392/437; 392/438; 392/439; 392/440

(58) Field of Classification Search
USPC ..... 392/407, 411, 417, 432–440; 219/200, 219/201, 216
See application file for complete search history.

(56) References Cited

U.S. PATENT DOCUMENTS 1,076,858 A * 10/1913 Andrews ..... 338/237
1,630,787 A * 5/1927 Cullen ..... 99/416
2,965,868 A * 12/1960 Eichler ..... 338/261
3,313,917 A * 4/1967 Ditzler et al. ..... 219/400
4,874,454 A * 10/1989 Talalay et al. ..... 156/359
5,018,438 A * 5/1991 Grandi ..... 99/335
5,223,137 A * 6/1993 Hattori et al. ..... 210/368
5,296,081 A * 3/1994 Morin et al. ..... 156/498
5,706,588 A * 1/1998 Dausch et al. ..... 34/327
5,711,837 A * 1/1998 Kantrowitz ..... 156/215
5,997,678 A * 12/1999 Wess et al. ..... 156/240
RE37,706 E * 5/2002 Chung ..... 99/404
6,425,663 B1 * 7/2002 Eastlund et al. ..... 347/102
6,444,964 B1 * 9/2002 Eastlund et al. ..... 219/695
6,491,361 B1 * 12/2002 Spann ..... 347/2
6,508,550 B1 * 1/2003 Eastlund et al. ..... 347/102
6,520,999 B1 * 2/2003 Kamata et al. ..... 8/471
7,563,341 B2 * 7/2009 Ferguson et al. ..... 156/285
7,671,301 B2 * 3/2010 Elkasevic ..... 219/407
7,885,557 B2 * 2/2011 Harris ..... 399/33
8,063,342 B2 * 11/2011 Hines, Jr. ..... 219/400
8,065,954 B2 * 11/2011 Foster et al. ..... 99/336
8,274,537 B2 * 9/2012 Howell et al. ..... 347/186
2004/0007137 A1 * 1/2004 Hwang ..... 99/330
2005/0070434 A1 * 3/2005 Drake ..... 503/227
2006/0028531 A1 * 2/2006 Magee et al. ..... 347/223
2007/0062923 A1 * 3/2007 Smith ..... 219/216
2007/0163450 A1 * 7/2007 Zaghloul et al. ..... 99/495
2008/0000579 A1 * 1/2008 Bortolato ..... 156/235
2008/0258339 A1 * 10/2008 Conrad ..... 264/293
2010/0023155 A1 * 1/2010 Conrad ..... 700/119
2012/0044312 A1 * 2/2012 Hirst ..... 347/172

* cited by examiner

*Primary Examiner* — Joseph M Pelham
*Assistant Examiner* — Jimmy Chou
(74) *Attorney, Agent, or Firm* — Stites & Harbison PLLC; Juan Carlos A. Marquez, Esq.

(57) ABSTRACT

A heating module for dye sublimation printing on an article comprises a first heating plate, an infrared heating source, and a metal shield. The infrared heating source is disposed under the first heating plate and emits a radiation. The metal shield can prevent the radiation, emitted by the infrared heating source, from projecting directly on the article. The first heating plate preheats a retransfer sheet to be softened and then molded on the article. Consequently, the infrared heating source heats the retransfer sheet for sublimation dye transfer on the article.

10 Claims, 6 Drawing Sheets

DYE SUBLIMATION HEATING MODULE AND SYSTEM THEREOF

TECHNICAL FIELD

The present invention relates to a heating module and a system thereof. More particularly, the present invention relates to a heating module and a system for dye sublimation printing.

BACKGROUND

Thermal retransfer printing involves forming an image (in reverse) on a retransfer intermediate sheet using one or more thermally transferable dyes. The image is then thermally transferred to a surface of an article by bringing the image into contact with the article surface and applying heat.

Conventional infrared heating sources suffer from a number of issues. The retransfer intermediate sheet is typically preheated to be easily applied to and conform to the contours of an article. In order to achieve uniform heating of the sheet, it must be positioned equidistant from the infrared heating source. Since it is difficult to optimize the equidistant position of the retransfer sheet when using infrared heating sources, the retransfer sheet is sometimes too soft to properly conform to the contours of three dimensional (3D) articles and sometimes too hard to be appropriately applied on the surface of 3D articles. In addition, the radiation of the infrared heating source might be so intense that the retransfer intermediate sheet could be deformed due to the intense radiation.

In addition, since the conventional infrared heating source can reach its predetermined temperature quickly, the acute radiation from the infrared heating source might damage certain fragile articles. However, if the predetermined temperature setting is reduced, the thermal transfer process will be too slow for economical production.

Moreover, the infrared heating source is not optimized for 3D articles that have upwardly projecting portions, as side or lower surfaces of the articles tend to remain cooler than upper surfaces. This results in uneven heating of 3D articles and the sheet and consequent variable dye transfer, with potentially poor dye transfer occurring on cooler regions of an article. This can result in poor overall print quality.

SUMMARY

To solve the above-mentioned problems of the prior art, the present invention discloses a heating module for dye sublimation printing on an article. The heating module comprises a first heating plate, an infrared heating source for emitting radiation, and a metal shield to prevent the radiation from projecting directly on the article. Since the infrared heating source is disposed under the first heating plate, the infrared heating source is disposed between the first heating plate and the article. Because the direct radiation might damage the fragile article, the metal shield is disposed between the infrared heating source and the article. Therefore, the radiation from the infrared heating source is emitted indirectly on the article. In addition, the main function of the first heating plate is to preheat and soften a retransfer sheet for proper application on the article. In contrast to the first heating plate, the infrared heating source can rapidly heat the retransfer sheet molded to the article to reduce the duration of the dye transfer process.

In addition, the present invention discloses a system for dye sublimation printing on an article. The system comprises a heating module, an air introduction inlet, an evacuation outlet, a container, and a guide rail. The heating module comprises a first heating plate, an infrared heating source, and a metal shield. The infrared heating source is disposed under the first heating plate and emits radiation toward the container for heating a retransfer sheet molded on the article. Prior to heating of the retransfer sheet, the first heating plate preheats the retransfer sheet for appropriate attachment on the article. Moreover, the air introduction inlet introduces the air into a space between the retransfer sheet and the first heating plate and allows heated air to be evenly distributed. The evacuation outlet maintains a vacuum pressure between the retransfer sheet and the article to prevent a bubble from forming therebetween. Furthermore, the container holding the article includes a heat insulation wall, which maintains the temperature with the container to prevent warping of the article due to chilling effect. The guide rail is connected to the bottom of the container to automatically transport the container without manual control.

The foregoing has outlined rather broadly the features and technical advantages of the present invention in order that the detailed description of the invention that follows may be better understood. Additional features and advantages of the invention will be described hereinafter, and form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The accompanying drawings, which are incorporated in and constitute a part of this specification, illustrate embodiments of the disclosure and, together with the description, serve to explain the principles of the invention.

DETAILED DESCRIPTION

Figure 1:
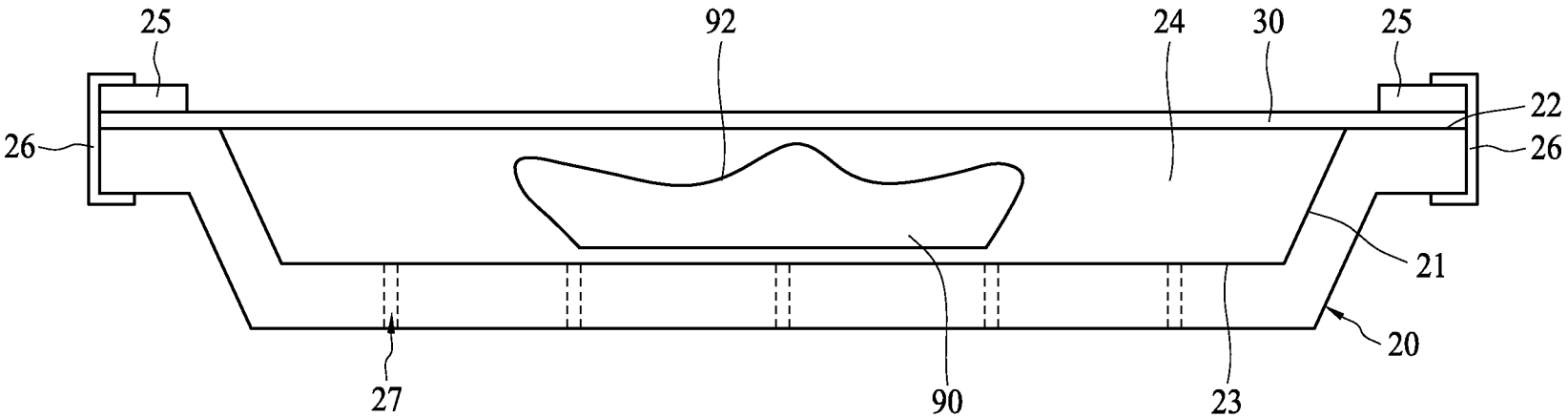
FIG. 1 shows a schematic representation of the first step of a dye sublimation process according to one embodiment of the present invention.

Some preferred embodiments of the present invention will be described with reference to the accompanying drawings, in which like reference numerals designate same or corresponding portions.

FIGS. 1 to 4 show a modular process for decorating an article 90. Each step is described in greater detail below. The article 90 may comprise a complex geometrical surface 92 to be printed by the process. In FIG. 1, the article 90 is mounted on a container 20. A retransfer sheet 30 is positioned on the container 20 over the article 90 and secured to the rim portion 22, which is located at an uppermost region of sidewall 21 of the container 20. A predetermined distance between the bottom surface 23 of the container 20 and the retransfer sheet 30 preferably ranges from 0.5 cm to 3 cm for printing a variety of articles of different materials.

In the embodiment shown in FIG. 1, a deep-walled container 20 has a sidewall 21, which is positioned in an upstanding manner relative to a substantially horizontal bottom surface 23, thus defining an enclosure 24 within the container 20. The article 90 is held within the enclosure 24. In other words, the article 90 is secured on the bottom surface 23 of the container 20.

The prior art disclosed a container (not shown) formed from a thermally conductive material such as a metal, e.g. aluminum, to enhance cooling of the container. Due to rapid cooling of the container in the prior art, the article held by the container might be affected by uneven or cold air temperatures, causing the article to warp. In order to resolve such defect, the sidewall 21 of the embodiment shown in FIG. 1 can be coated with heat insulation material; thus, the sidewall 21 is also called a heat insulation wall 21, which can keep heat from escaping. Therefore, the heat insulation wall 21 can prevent the warping of the article 90 due to cooling effect suffered by the container in the prior art. The heat insulation material can be selected from polypropylene, rubber and epoxy. The thermal conductivity preferably has to below 0.0011 Kcal/m·s·° C.

Referring to FIG. 1, the container 20 further includes at least one locking member 25 and clasps 26. The locking member 25 and the clasps 26 fix the retransfer sheet 30 on the rim portion 22, thus ensuring that the retransfer sheet 30 is correctly positioned on the container 20 during operation. Although a pair of locking members 25 and clasps 26 are shown in this embodiment, in practice according to various designs, one appropriately positioned locking member 25 and clasps 26 would suffice.

Referring to FIGS. 1 to 4, the bottom surface 23 is provided with a number of non-return valves 27, each valve 27 being configured to permit fluid flow and air flow through the valve 27 in one direction only. The air or fluid is drawn through the valve 27 from the enclosure 24 defined by the heat insulation wall 21 of the container 20 to the exterior of the container 20. Although a plurality of valves 27 is shown in this embodiment, in practice according to various designs, one appropriately positioned valve 27 would suffice. In addition, a vacuum pump (not shown) draws the air or fluid out from the container 20 for maintaining a partial vacuum that is suitably in the range of from 5 to 25 kPa or 20 to 60 kPa below atmospheric pressure.

Figure 5:
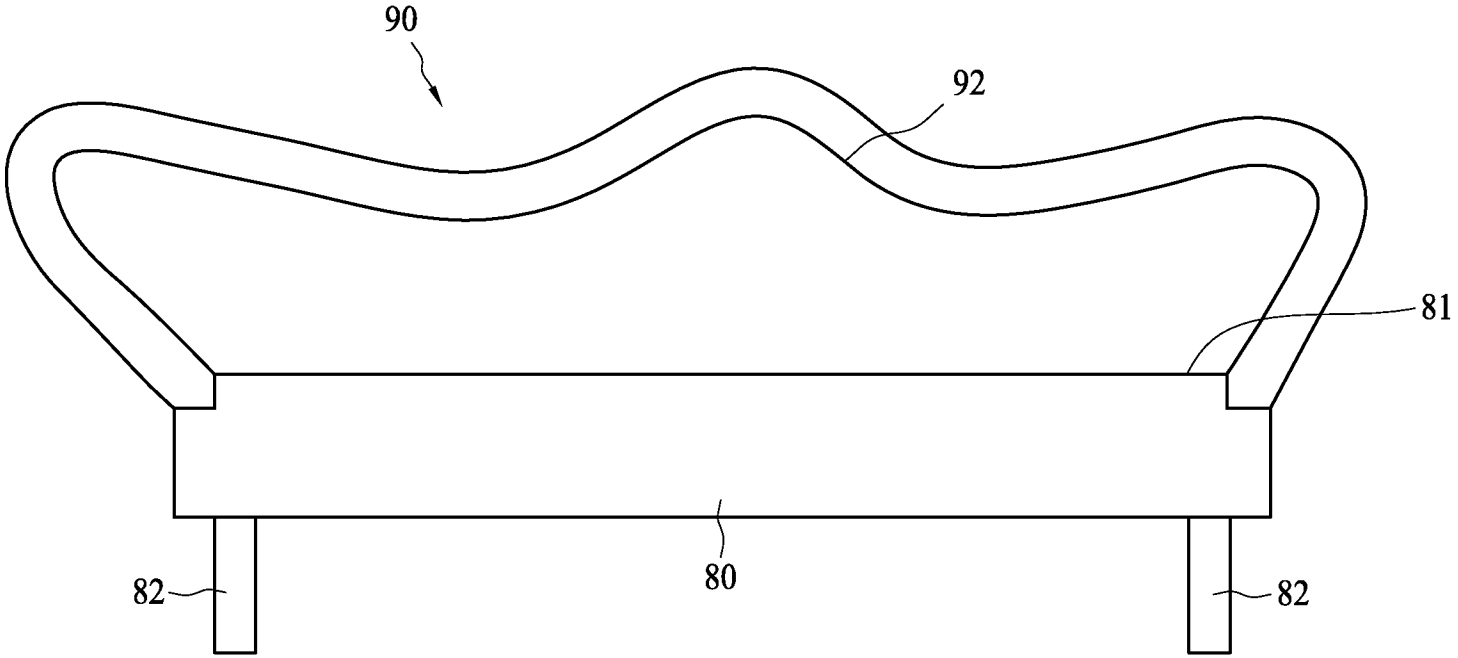
FIG. 5 illustrates a complex geometrical article mounted on a nest.

In a first step of operation as shown in FIG. 1, the article 90 to be decorated may be located directly on the bottom surface 23. The article 90 can be made of a wide range of materials selecting from plastics, metal, ceramics, wood, and composite materials. Alternatively, the article 90 may be mounted on a nest 80, as illustrated in FIG. 5. The nest 80 includes a compliant material such as an elastomeric material, e.g. rubber, steel, or aluminum. An upper surface 81 of the nest 80 is configured to receive an underside of the article 90 and retain it securely on the article 90, which can be of solid or thin-walled construction. An underside of the nest 80 is provided with two or more locator pins 82, used to accurately position the nest 80, and therefore the article 90 is disposed on the bottom surface 23 in the enclosure 24 of the container 20. The bottom surface 23 includes bores (not shown) corresponding to the locator pin 82. This location mechanism further ensures that the image or design provided on the retransfer sheet 30 is accurately registered with the article 90 to result in a predictable finished printed product.

Once the article 90 has been located in the container 20, the retransfer sheet 30 is disposed onto the rim portion 22. In FIG. 1, the retransfer sheet 30 is positioned between the locking member 25 and the rim portion 22 to ensure registration of the image or design printed to relevant features of the article 90. While the locking member 25 is positioned over the retransfer sheet 30, clasps 26 are moved into position, such that clasps 26 grip an underside of the rim portion 22 and clamp the locking member 25 onto the container 20.

Figure 2:
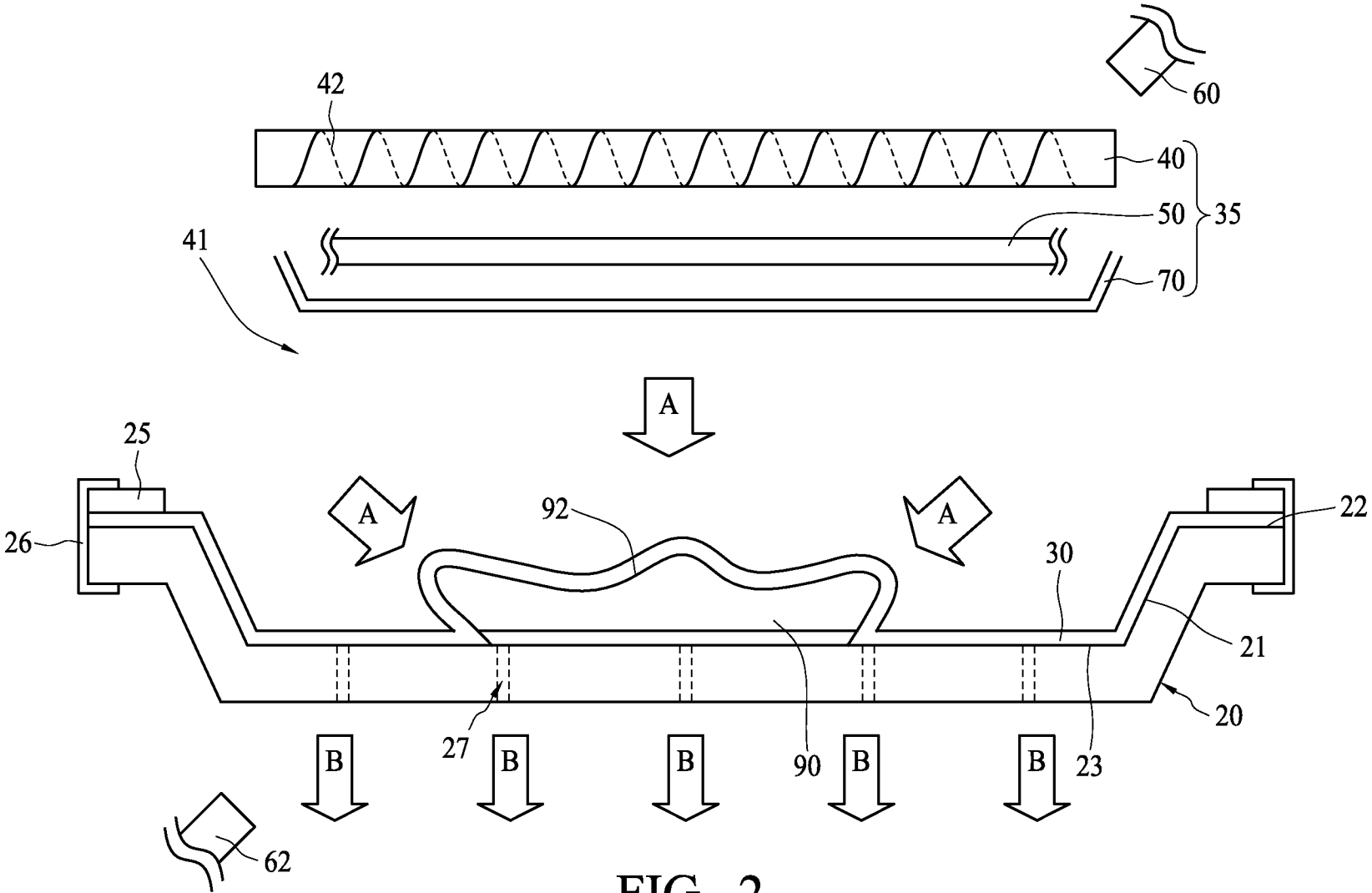
FIG. 2 shows a schematic representation of the second step of a dye sublimation process according to one embodiment of the present invention.

In the second step as shown in FIG. 2, a first heating plate 40 is disposed on the infrared heating source 50. In other words, the infrared heating source 50 is disposed under the first heating plate 40 and is covered by a metal shield 70. The distance (D1) between the first heating plate 40 and the retransfer sheet 30 is important for softening the retransfer sheet 30. The preferred distance (D1) between the first heating plate 40 and the retransfer sheet 30 ranges from 3 to 20 cm and may be customized to suit the article's 90 particular material. The first heating plate 40, the infrared heating source 50, and the metal shield 70 constitute a heating module 35. The heating module 35 is operable to cause preheating of the retransfer sheet 30 (typically to a temperature in the range 40 to 100° C., commonly about 65° C.) to soften the retransfer sheet 30, which is heated by exposure to a flow of heated gas prior to bringing the retransfer sheet 30 and the article 90 into contact. In the second step, the first heating plate 40 preheats air introduced by an air introduction inlet 60 so as to gently preheat the retransfer sheet 30. Particularly, the air introduction inlet 60 introduces air (at a wind speed ranging from 500 $m^3$/h to 3000 $m^3$/h) into a space 41 between the retransfer sheet 30 and the first heating plate 40. Air in the space 41 is preheated by the first heating plate 40 to soften the retransfer sheet 30; in the meanwhile, an evacuation outlet 62 evacuates air or fluid from the valve 27 for maintaining a vacuum pressure that is suitably at a level in the range of from 5 to 25 kPa (e.g. about 5 kPa) below atmospheric pressure and for gentle contact between the retransfer sheet 30 and the 3D article 90. Subsequently, the evacuation outlet 62 maintains a vacuum pressure at a level in the range of from 20 to 60 kPa (e.g. about 50 kPa) below atmospheric pressure for complete attachment between the retransfer sheet 30 and the 3D article 90. The process from low vacuum pressure (about 5 kPa) to high vacuum pressure (about 50 kPa) is a gradual vacuum program, which can be regulated by a control mean (not shown). The shifting error refers to the distance between the pattern after dye transferring and the pattern originally designed to print on the article 90. The gradual vacuum program can significantly reduce the shifting error. Thus, the preheated retransfer sheet 30 is properly softened for application on the predetermined location of the surface of 3D article 90. In addition, an evacuation outlet 62 evacuates air or fluid from the valve 27 for maintaining a vacuum pressure between the retransfer sheet 30 and the 3D article 90. In particular, the evacuation outlet 62 for creating a vacuum may include a vacuum pump or a compressor (not shown in detail) to drain air or fluid out.

A tungsten coil 42 of the first heating plate 40 is activated and heat is applied ("A" in FIG. 2) to the retransfer sheet 30 whereby the temperature of the retransfer sheet 30 is raised so that the retransfer sheet 30 softens and becomes formable to mold to the 3D article 90. Therefore, the first heating plate 40 can prevent the retransfer sheet 30 from being too soft or too hard to properly conform to the contours of the 3D article 90. Furthermore, the system for dye sublimation printing on the article 90 is controlled by predetermined temperature, instead of by heating period. The temperature for heating the retransfer sheet 30 to cause dye transfer is typically in the range of from 100 to 240° C., commonly about 160° C. The distance between the article 90 and the first heating plate 40 preferably ranges from 2 to 15 cm for stably maintaining the dye-transfer temperature; consequently the temperature applied by the first heating plate 40 analogically increases from room temperature to 100° C. (preheating), which is controlled by an analogically heating program controlled by a control mean (not shown). By controlling temperature, the system provides a gentle heating process, and the system can prevent damage due to high intensity of the infrared heat source 50 in a period of short time such as one microsecond. In the embodiment shown in FIG. 2, a very even final temperature distribution over the retransfer sheet 30 is achieved to enhance the integrity of the retransfer sheet 30 once it is formed into its final topology.

The evacuation outlet 62 is then activated such that any air located between the retransfer sheet 30 and the 3D article 90 is drawn through non-return valves 74 located in the bottom surface 23 ("B" in FIG. 2). The locking member 25 and the impermeable nature of the retransfer sheet 30 enable a vacuum to be formed between the retransfer sheet 30 and the article 90. The vacuum is drawn in a very controlled manner, slowly at first (about 1 kPa), gradually building to middle power (about 20 kPa) in order to comprehensively evacuate the environment within the enclosure 24. The vacuum causes the retransfer sheet 30 to be urged to conform to the surface 92 of the article 90 and ensures a good level of contact to prevent a bubble from forming between the retransfer sheet 30 and the article 90. The non-return valve 27 serves to retain the vacuum, once the evacuation outlet 62 has been deactivated.

Figure 3:
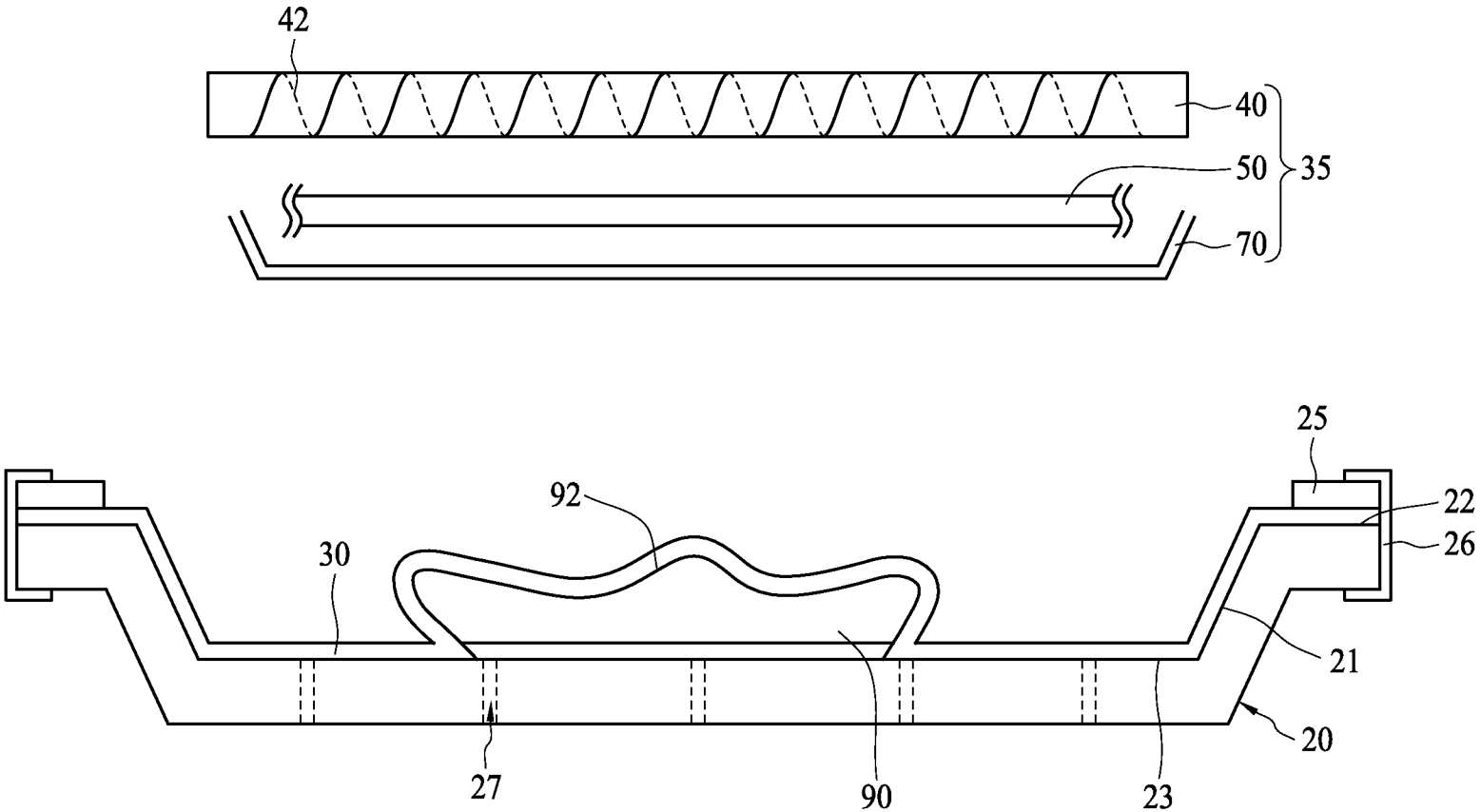
FIG. 3 shows a schematic representation of the third step of a dye sublimation process according to one embodiment of the present invention.

In the third step, shown in FIG. 3, the infrared heating source 50 of the heating module 35 is activated to emit a radiation. Since the metal shield 70 is disposed between the infrared heating source 50 and the article 90, the metal shield 70 can prevent radiation from projecting directly on the article 90, which could result in damage due to the acute radiation from the infrared heating source 50. In addition, the metal shield 70 also allows the reflected radiation to cooperate with the heated air from the first heating plate 40, to heat the retransfer sheet 30 molded on the article 90 for rapid sublimation dye transfer. However, the distance (D2) between the infrared heating source 50 and the article 90 may affect the speed for sublimation dye transfer and preferably ranges from 1 to 10 cm; consequently, the distance between the metal shield 70 and the article 90 ranges 0.5 to 9 cm for perfect refection of the radiation emitted from the infrared heating source 50. In addition, during the rapid sublimation dye transfer, the infrared heating source 50 and the analogically heating program are activated at the same time.

Figure 4:
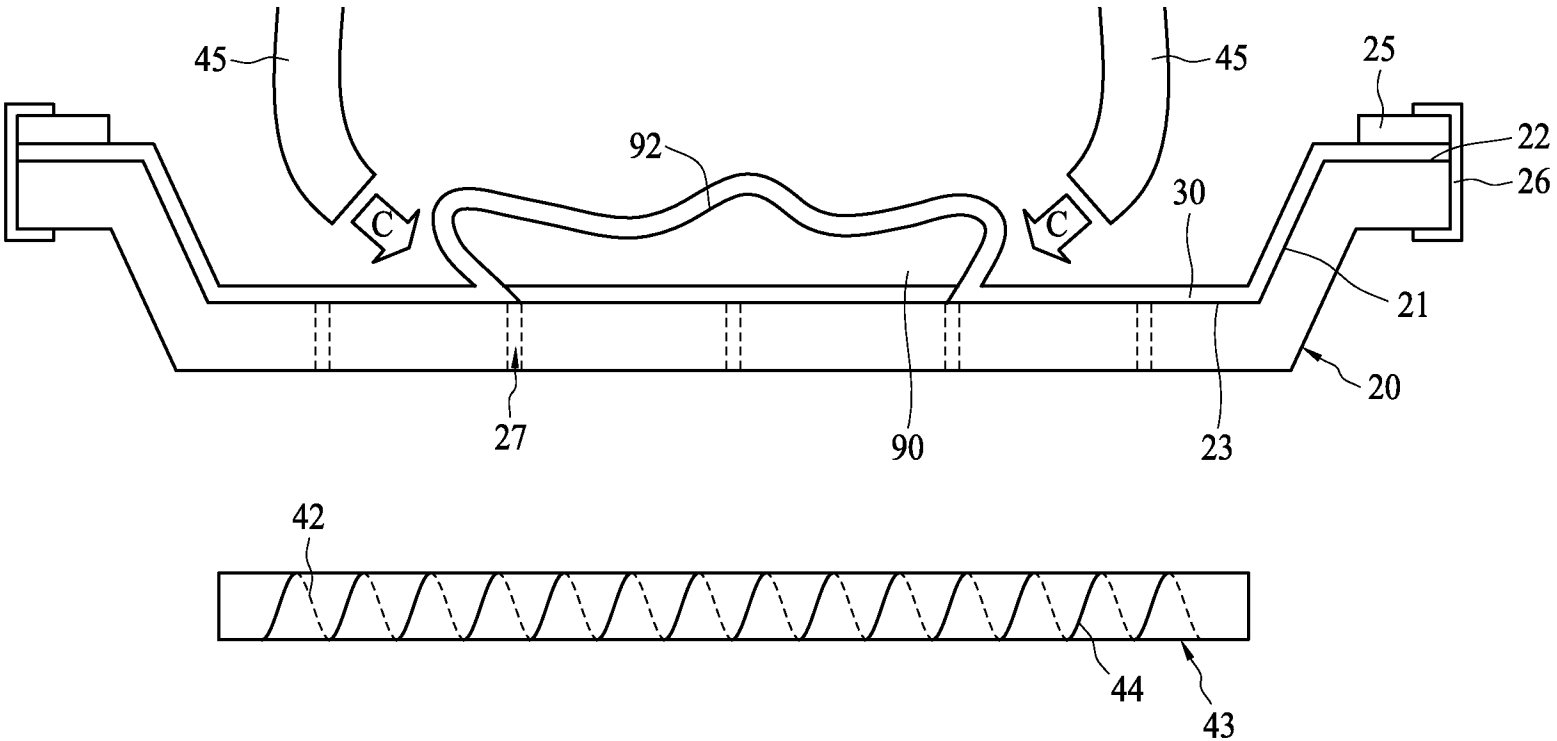
FIG. 4 shows a schematic representation of the fourth step of a dye sublimation process according to one embodiment of the present invention.
Figure 6:
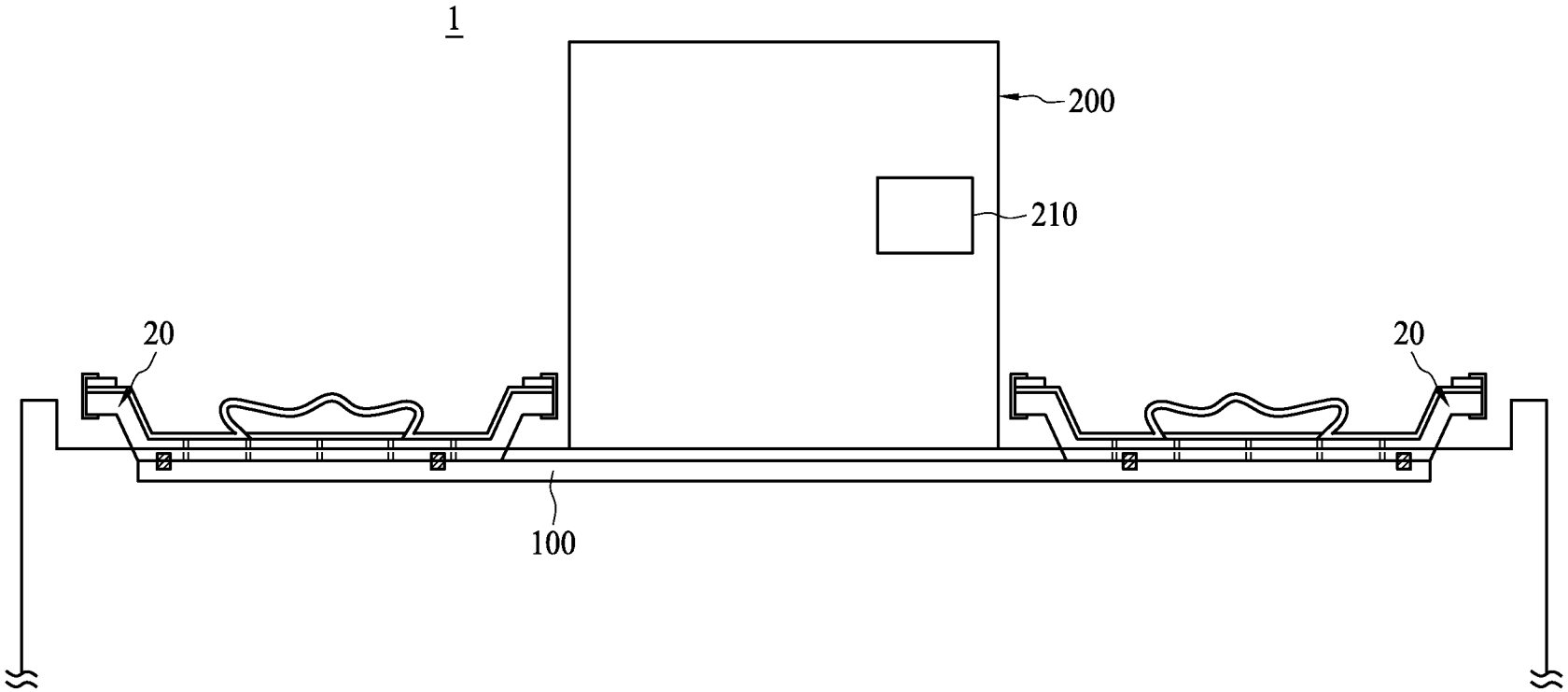
FIG. 6 illustrates a system for dye sublimation printing and a guide rail transporting the container according to one embodiment of the present invention.

In the fourth step, shown in FIG. 4, the heating module 35 further includes a second heating plate 43, which is disposed under the bottom surface 23 of the container 20 and the article 90. The distance (D3) between the second heating plate 43 and the bottom surface 23 ranges from 2 to 5 cm. The second heating plate 43 also includes a tungsten coil 44, which maintains the temperature (ranging from 50 to 100° C.) of the container 20 to prevent the warping of the article 90 due to the chilling effect. In addition, the heating module 35 further includes at least one tube 45. In the embodiment, there are two tubes 45 disposed corresponding to the lateral side of the 3D article 90. In practice according to various designs, one appropriately positioned tube 45 would suffice and is capable of guiding air heated by the infrared heating source 50 shown in FIG. 3 and the first heating plate 40 to the article 90. In particular, the tube 45 introduces the heated air to lateral sides of the article 90 ("C" in FIG. 4), which circulate the air around the side or lower surfaces of the article 90. Thus, the side or lower surfaces of the 3D article 90 do not remain cooler than upper surface. The design of the tube 45 allows dye to equally transfer on the side or lower surfaces of the 3D article 90 for increasing overall print quality. In addition, the wind speed of the heating air from the tube 45 will affect the air circulation around the side or lower surfaces of the article 90 and preferably ranges from 500 $m^3/h$ to 3000 $m^3/h$ In FIG. 6, the system 1 for dye sublimation printing include the above-mentioned heating module 35, the air introduction inlet 60, an evacuation outlet 62 shown in FIG. 2, the container 20, and the guide rail 100. The guide rail 100 is connected to a bottom of the container 20 so as to automatically transport the container 20 into the processing chamber 200 for the modular process shown in FIGS. 1 to 4. In addition, the external surface of the processing chamber 200 includes an operation panel 210, which can monitor which modular process has been reached or whether the processing temperature has been sensed for the next modular step.

Example 1

| | Test number | | | | |
|---|---|---|---|---|---|
| | 1 | 2 | 3 | 4 | 5 |
| Preheating | none | 20~80 s at 40~100° C. | none | 20~80 s at 40~100° C. | 20~80 s at 40~100° C. |
| Dye-transfer heating | 40~100 s at 100~180° C. | 40~100 s at 100~180° C. | 40~100 s at 100~180° C. | 40~100 s at 100~180° C. | 40~100 s at 100~180° C. |
| Analogically heating program | Non-activation | Activation | Non-activation | Non-activation | activation |
| Low vacuum pressure | 5~20 kPa | Non-activation | Non-activation | 5~20 kPa | 5~20 kPa |
| High vacuum pressure | 20~60 kPa | 20~60 kPa | 20~60 kPa | 20~60 kPa | 20~60 kPa |
| Gradual vacuum program | activation | Non-activation | Non-activation | activation | activation |
| Tube activation | Non-activation | Activation Wind speed: 1000 $m^3/h$ | Activation Wind speed: 1000 $m^3/h$ | Activation Wind speed: 1000 $m^3/h$ | Activation Wind speed: 180 $m^3/h$ |

-continued

| | Test number | | | | |
|---|---|---|---|---|---|
| | 1 | 2 | 3 | 4 | 5 |
| D1 distance | 3~20 cm | 3~20 cm | 3~20 cm | 3~20 cm | 3~20 cm |
| D2 distance | 1~10 cm | 1~10 cm | 1~10 cm | 1~10 cm | 1~10 cm |
| D3 distance | 2~5 cm | 2~5 cm | 2~5 cm | 2~5 cm | 2~5 cm |
| Shifting error | ∓2 mm ↑ | ∓1.0 mm | ∓3 mm ↑ | ∓0.5 mm | ∓0.3 mm |

According to measurement of these shifting errors, it is obvious that the analogically heating program, the preheating process, the tube activation, and gradual vacuum program all significantly affect measurements of the shifting error.

Although the present invention and its advantages have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A heating module for dye sublimation printing on an article, the heating module comprising:

a first heating plate;

an infrared heating source, disposed under the first heating plate and emitting a radiation;

a metal shield disposed under the infrared heating source, preventing the radiation from projecting directly on the article which is beneath the metal shield; and a second heating plate disposed under the article, wherein the first heating plate preheats a retransfer sheet, and the infrared heating source heats the retransfer sheet molded on the article.

2. The heating module of claim 1, wherein the first heating plate and the second heating plate include tungsten coil.

3. The heating module of claim 1, further comprising a tube, guiding air heated by the infrared heating source to the article.

4. The heating module of claim 3, wherein the tube introduces the heated air to lateral sides of the article.

5. A system for dye sublimation printing on an article, the system comprising:

a heating module comprising:

a first heating plate, an infrared heating source, disposed under the first heating plate and emitting a radiation, and a metal shield disposed under the infrared heating source, preventing the radiation from projecting directly on the article, which is beneath the metal shield, wherein the first heating plate preheats a retransfer sheet, and the infrared heating source heats the retransfer sheet molded on the article;

an air introduction inlet, introducing air into a space between the retransfer sheet and the first heating plate;

an evacuation outlet, maintaining a vacuum pressure between the retransfer sheet and the article;

a container, holding the article and including a heat insulation wall; and a guide rail, connected to a bottom of the container.

6. The system of claim 5, wherein the heating module further includes a second heating plate, disposed under the article.

7. The system of claim 6, wherein the first heating plate and the second heating plate include a tungsten coil.

8. The system of claim 5, wherein the heating module further includes a tube, guiding air heated by the infrared heating source to the article.

9. The system of claim 8, wherein the tube introduces the heated air to lateral sides of the article.

10. The system of claim 5, wherein a predetermined distance between the article and the retransfer sheet ranges from 0.5 cm to 3 cm.

* * * * *